United States Patent [19]

Sando et al.

[11] 4,182,141

[45] Jan. 8, 1980

[54] APPARATUS FOR CARRYING OUT CONTINUOUS CLOTH MATERIAL TREATING PROCESS

[75] Inventors: Yoshikazu Sando; Hiroshi Ishidoshiro, both of Wakayama, Japan

[73] Assignee: Sando Iron Works Co., Ltd., Wakayama, Japan

[21] Appl. No.: 906,853

[22] Filed: May 17, 1978

[30] Foreign Application Priority Data

Jun. 1, 1977 [JP] Japan ..... 52-64163
Sep. 14, 1977 [JP] Japan ..... 52-110785

[51] Int. Cl.[2] ..... D06B 3/10
[52] U.S. Cl. ..... 68/5 E; 68/9; 68/62; 68/152; 68/177; 68/181 R
[58] Field of Search ..... 8/149.1; 68/3 SS, 5 D, 68/5 E, 152, 181 R, 177, 178, 9, 27

[56] References Cited

U.S. PATENT DOCUMENTS

| | | | |
|---|---|---|---|
| 1,741,338 | 12/1929 | Rowley et al. | 8/149.1 |
| 3,631,692 | 1/1972 | Garzotto | 68/152 X |
| 3,906,755 | 9/1975 | Sando et al. | 68/5 E X |
| 3,955,386 | 5/1976 | Meier-Windhorst | 68/5 D |

*Primary Examiner*—Philip R. Coe
*Attorney, Agent, or Firm*—Toren, McGeady and Stanger

[57] ABSTRACT

A method and an apparatus for carrying out a continuous cloth material treating process through a high pressure steamer drum body which is capable of keeping a high humid heat within it and permits entrance into and exit therefrom of a cloth material to be treated in a continuous manner. An arrangement of one or a plurality of liquid flow tanks is provided inside the high pressure steamer drum body to effect conveyance of the cloth material through the inside of the liquid flow tank arrangement by means of a liquid flow which takes place there. A liquid supply piping arrangement is provided for returning liquid which overflows one end of the liquid flow tank arrangement, back to the other end of the tank arrangement.

3 Claims, 2 Drawing Figures

APPARATUS FOR CARRYING OUT CONTINUOUS CLOTH MATERIAL TREATING PROCESS

BACKGROUND OF THE INVENTION

This invention relates to an apparatus for continuously carrying out a cloth material treating process such as dyeing, etc. to obtain continuously and economically an excellently dyed material having an excellent feel by utilizing the advantageous features of high pressure steaming in combination with a liquid flowing operation.

The conventional methods for dyeing, for example, a long cloth material, are roughly divided into two types. One is a continuous dyeing method in which a cloth material to be treated is continuously allowed to pass through the inside of a steamer drum body which is capable of keeping high humid heat therein. The other is a batch dyeing process in which a cloth material of a given length is placed inside a steamer drum body which can be made to have high humid heat and the cloth material is subjected to hygro-thermic treatment for a preset period of time there. In the continuous dyeing method, although such a continuous dyeing process is possible thereby, the feel of the cloth material is impaired by the tension of the cloth while it is being guided within the steamer drum body through many guide rolls which are arranged therein to guide the cloth material for the hygro-thermic treatment and then to the outside of the steamer drum body. In the case of a thin or knit cloth material, such tension particularly tends to cause wrinkles or stitch deformation. In the batch dyeing method, a length of a cloth material corresponding to several rolls of cloth is placed in a steamer drum body for each batch process. About 7 tons of water in which a dye and a promoter are mixed is put in the steamer drum. Then, temperature inside the steamer drum body is raised from normal temperature up to a high temperature of about 130° C. and dyeing is effected through a liquid flowing process for a period of time of about two to three hours. After that, the steamer drum body is opened to replace the cloth material and the treating liquid and then the temperature inside the steamer drum body is again raised to repeat the same dyeing process. The batch method provides a dyed cloth material having a good feel because no tension is caused during the process. However, the heat energy, the dye solution and the promoter are wasted in large quantities every time the steamer drum body is opened. Besides, in accordance with this batch dyeing method, a long period of time is required before completion of dyeing and it takes two or three hours for dyeing several rolls of the cloth material. Further, the result of dyeing one batch tends to vary from that of another batch.

SUMMARY OF THE INVENTION

It is therefore a general object of this invention to provide an apparatus for a continuous cloth material treating process wherein a liquid flowing arrangement is provided inside a drum body which permits a cloth material to more continuously into the drum body and to move continuously out of the drum body and yet is capable of keeping pressure humid heat therein for continuous hygro-thermic treatment of a long cloth material, and the cloth material can be conveyed in a state of no tension through a liquid flowing operation within the drum body for eliminating the shortcomings of the conventional methods. The term "continuous treating process" as used in this invention means to carry out a process such as dyeing, scouring, bleaching, washing, etc. through a liquid flowing operation.

The above and other objects and features of the invention will be apparent from the following detailed description of embodiments thereof when read in connection with the accompanying drawings.

BRIEF DESCRIPTION OF THE DRAWINGS

The accompanying drawings illustrate preferred embodiments of the invention.

DETAILED DESCRIPTION OF PREFERRED EMBODIMENTS

Figure 1:
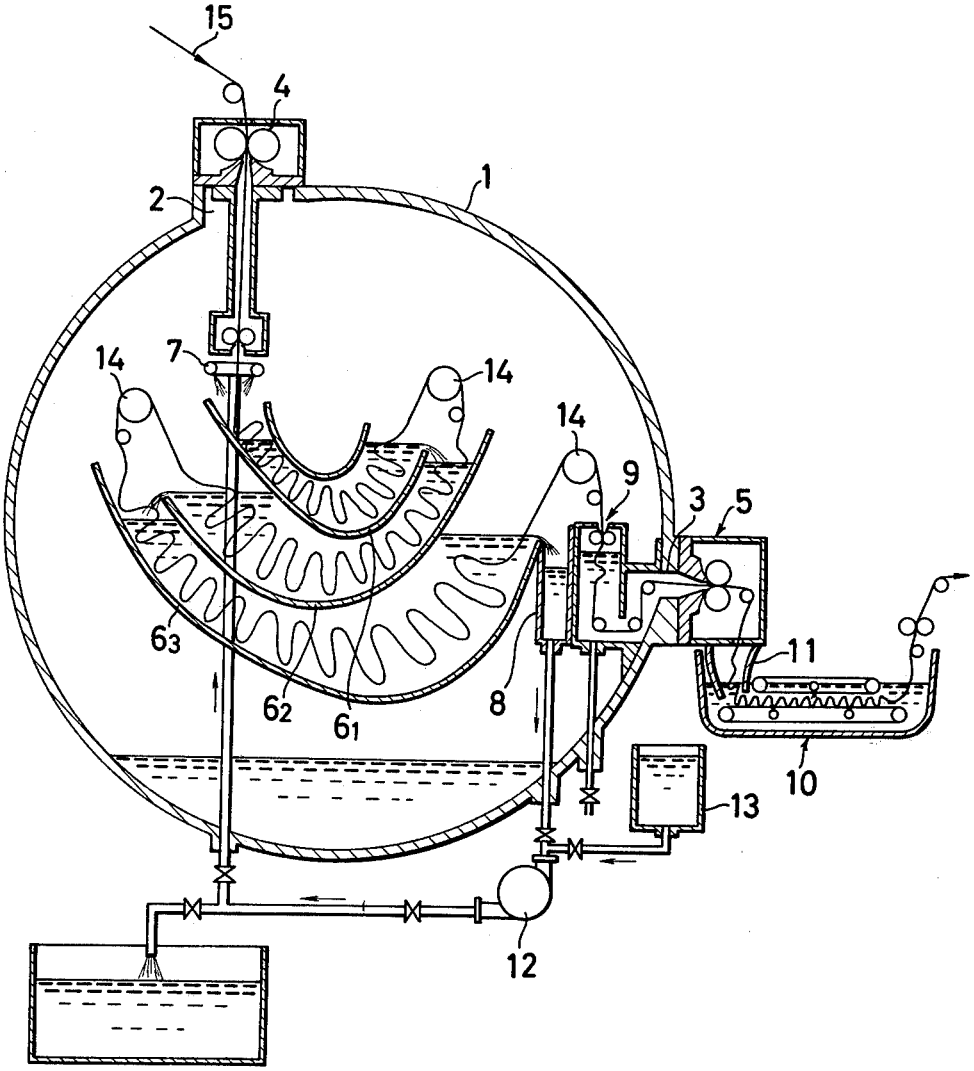
FIG. 1 is a sectional view showing a first embodiment example of the invention and FIG. 2 another sectional view showing a second embodiment example.

Referring to FIG. 1 which shows a first embodiment of the invention, a reference numeral 1 indicates a steamer drum body which is provided for treating a cloth material under high pressure humid heat. The steamer drum body is provided with a cloth inlet 2 and a cloth outlet 3. At the inlet 2 and the outlet 3, there is provided an entrance seal mechanism 4 and an exit seal mechanism 5, respectively which permit passing of the cloth material but serve to keep the high pressure humid heat inside the steamer drum body 1. Reference numerals $6_1$, $6_2$ and $6_3$ indicate upper, middle and lower liquid flow tanks respectively. A liquid coming from a liquid supply pipe 7 first enters the upper liquid flow tank $6_1$ through one end thereof and overflows an opening provided in the opposite end thereof. The overflown liquid enters the middle liquid flow tank $6_2$ and overflows the brim of an opening provided in the opposite end thereof. The liquid overflown from the middle tank enters the lower liquid flow tank $6_3$ at one end thereof and overflows the brim of an opening provided in the opposite end thereof. The liquid which overflows from the liquid flow tank $6_3$ is deposited in a tank 8. In other words, the liquid which flows out of the liquid supply pipe 7 flows down in sequence through the liquid flow tanks $6_1$–$6_2$–$6_3$ and then enters the tank 8. A reference numeral 9 indicates a slow cooling tank disposed within the steamer drum body close to the exit seal mechanism 5. Slow cooling water is supplied to the inside of the slow cooling tank 9. A numeral 10 indicates a water washing tank which is provided for washing with water the cloth material guided out of the steamer drum body 1. Between the water washing tank 10 and the seal mechanism 5, there is provided a cover 11 for guiding the cloth material into the water washing tank 10 without allowing the cloth material to come into contact with the ambient air. A numeral 12 indicates a pump which is provided for returning the liquid from the tank 8 back to the liquid supply pipe 7; 13 indicates a liquid replenishing tank; 14 indicates cloth expanding feed rolls disposed between the liquid flow tanks; and 15 indicates the cloth material. The arrangement of the first embodiment example described in the foregoing operates as shown below:

First, the temperature of the inside of the steamer drum body 1 is adjusted to a high temperature between 115° and 155° C. The temperature varies with the property of the cloth material and the kind of the treatment process to be applied thereto. For example, the temperature inside the steamer drum body is preferably kept at about 115° C. in the case of a nylon cloth material and at about 155° C. for a polyester cloth material. Then, when the inside of the steamer drum body has been adjusted to a preset high humid heat temperature, the pump 12 is actuated to supply the treating liquid (which is a dyeing liquid in the case of dyeing treatment or an alkaline liquid in the case of scouring, bleaching, etc.) from the liquid supply pipe 7 to the liquid flow tanks $6_1$, $6_2$ and $6_3$ one after another in a circulating manner. Then, the cloth material 15 is allowed to enter the steamer drum body 1 through the seal mechanism 4. The cloth material passes through the liquid flow tanks $6_1$, $6_2$ and $6_3$ and is guided to the slow cooling tank 9. Then, the cloth material is guided through the seal mechanism and then to the water washing tank 10. Since, the cloth material supplied into the steamer drum body 1 is caused to flow by the liquid flowing operation, the cloth material moves forward in a relaxed state having no tension.

As described in the foregoing, in accordance with the present invention, a cloth material is continuously introduced into and is guided out of a high pressure steamer drum body which is capable of keeping high humid heat therein; and liquid flow tanks are arranged inside the high pressure steamer drum body to cause the cloth material to be conveyed by means of a liquid flow in a state of no tension. The cloth material, therefore, is treated with the liquid in a relaxed state while it is incessantly on the move inside the drum body. In accordance with the present invention, the provision of a plurality of liquid flow tanks with the slow cooling tank inside the steamer permits treatment of a cloth material to give a good result of dyeing, bulkiness and softness homogeneously in a short period of time. Besides, since the treatment is carried out continuously, water resource and heat energy can be economized to a great degree while the chemical liquid also can be saved from being wasted. Thus, the cloth material treating process can be highly economically carried out in a continuous manner in accordance with the invention.

Figure 2:
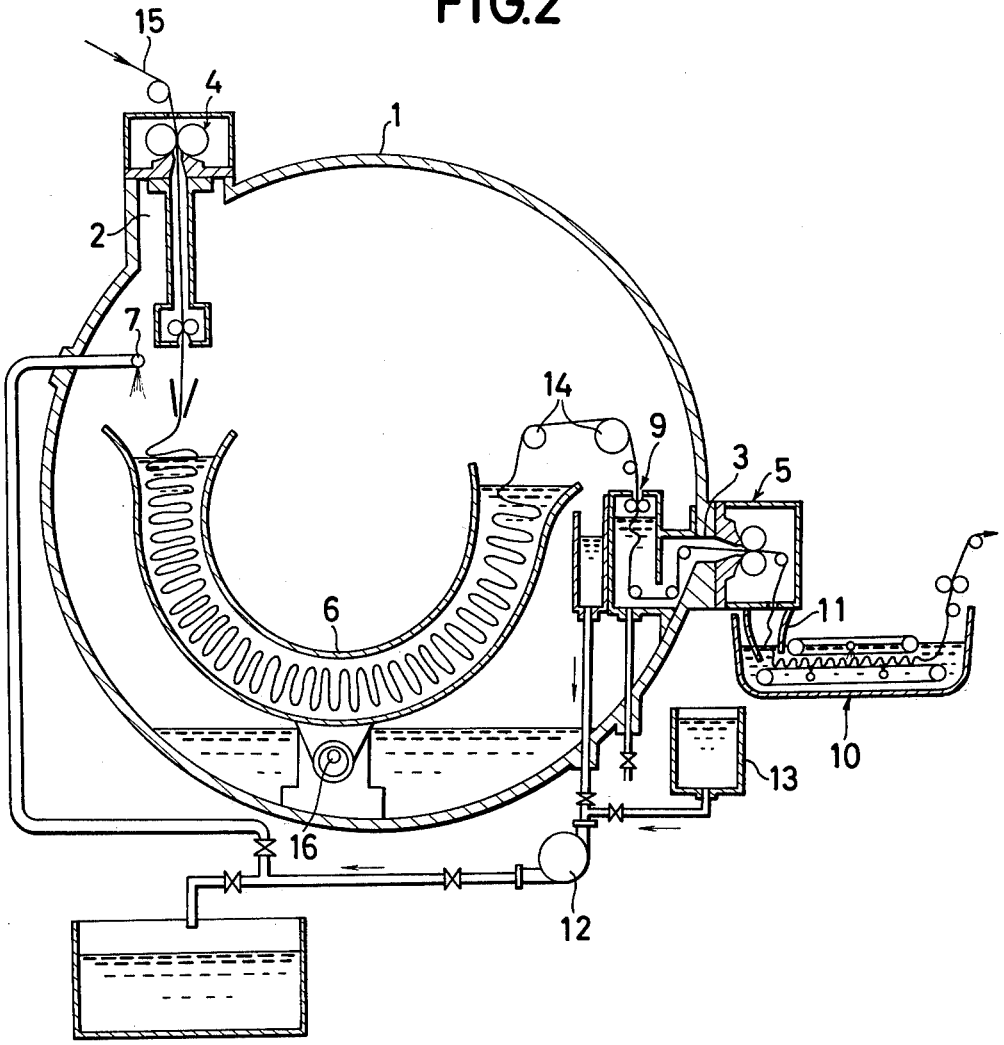

FIG. 2 shows a second embodiment example of the present invention. In this embodiment, there is provided only one liquid flow tank 6, which is coupled to and carried by an eccentric circular motion mechanism 16. When the mechanism 16 is operated, the liquid flow tank 6 is caused to sway by the eccentric circular motion of the mechanism 16 which thus shakes and moves a cloth material within the liquid flow tank 6 gradually toward the outlet of a steamer drum body. By this arrangement, the no tension conveyance of the cloth material can be more effectively carried out with a liquid flow aided by the eccentric circular motion.

What is claimed is:

1. Apparatus for carrying out a continuous cloth material treating process comprising a high pressure steamer drum having a cloth inlet and a cloth outlet, an entrance seal mechanism at said cloth inlet of said drum and an exit seal mechanism at said cloth outlet of said drum, a plurality of generally horizontally arranged liquid flow tanks including at least an upper tank and a lower tank, said lower tank positioned beneath said upper tank, each of said upper and lower tanks having an inlet end and an outlet end with an elongated flow passageway therebetween, the inlet end of each of said upper and lower tanks being located vertically above the outlet end thereof so that the treating liquid introduced into the inlet end flows to and overflows from the outlet end, the outlet end of said upper tank being positioned above the inlet end of said lower tank so that the treating liquid overflowing said upper tank flows into said lower tank, means for supplying a flow of treating liquid into the inlet end of said upper tank so that it continuously flows therethrough and then into said lower tank for flow therethrough from the inlet end to the outlet end thereof, means for guiding cloth material from said cloth inlet into the inlet end of said upper tank where the flow of the treating liquid carries the cloth material in a relaxed state through the elongated flow passageway therethrough to the outlet end thereof and then directs the cloth materials into the inlet end of said lower tank where the flow of the treating liquid carries the cloth material in a relaxed state through the elongated flow passageway therein to the outlet end thereof and then to the outlet from said steamer drum.

2. Apparatus, as set forth in claim 1, wherein a slow cooling tank is located between the outlet end of said lower tank and the outlet from said steamer drum and said means for guiding cloth material conveys the cloth material from the outlet end of said lower tank to said slow cooling tank and then to the outlet from said steamer drum.

3. Apparatus, as set forth in claim 1, wherein a water washin tank is located exteriorly of said steamer drum at the outlet from said drum for receiving and washing the cloth material exiting from said steamer drum, and a cover extending between the outlet from said steamer drum and said water washing tank arranged so that the cloth material exiting from said steamer drum passes into the water in said water washing tank without exposure to the ambient air.

* * * * *